US007829149B2

(12) United States Patent
Kim et al.

(10) Patent No.: US 7,829,149 B2
(45) Date of Patent: Nov. 9, 2010

(54) METHOD OF WATERPROOF AND FLOOR CONSTRUCTION BY USING THIXOTROPIC URETHANE AND FABRIC SHEET

(75) Inventors: Young Suk Kim, Seoul (KR); Seung Seock Han, Seoul (KR); Chang Taek Hyun, Seoul (KR); Jae Myung Choi, Seoul (KR)

(73) Assignees: Teknix D&C Co., Ltd. (KR); Samhwa Paints Ind. Co., Ltd. (KR); University of Seoul, Industry Cooperation Foundation (KR)

( * ) Notice: Subject to any disclaimer, the term of this patent is extended or adjusted under 35 U.S.C. 154(b) by 0 days.

(21) Appl. No.: 12/025,178

(22) Filed: Feb. 4, 2008

(65) Prior Publication Data

US 2008/0187671 A1 Aug. 7, 2008

(30) Foreign Application Priority Data

Feb. 5, 2007 (KR) ..... 10-2007-0011520

(51) Int. Cl.

| | |
|---|---|
| ***B05D 5/00*** | (2006.01) |
| ***B05D 1/02*** | (2006.01) |
| ***B05D 1/36*** | (2006.01) |
| ***B05D 3/10*** | (2006.01) |

(52) U.S. Cl. ..... 427/412; 427/427.4

(58) Field of Classification Search ..... 427/407.1, 427/411, 412, 427.4, 427.6, 427.7
See application file for complete search history.

(56) References Cited

U.S. PATENT DOCUMENTS

| | | | | |
|---|---|---|---|---|
| 2,192,183 | A * | 3/1940 | Deutsch | 264/278 |
| 5,418,260 | A * | 5/1995 | Smith | 521/159 |
| 6,460,304 | B1 * | 10/2002 | Kim | 52/408 |
| 6,806,212 | B2 * | 10/2004 | Fyfe | 442/104 |
| 6,895,689 | B2 * | 5/2005 | Ueno | 34/270 |

FOREIGN PATENT DOCUMENTS

| | | | |
|---|---|---|---|
| JP | 05-318673 | A * | 12/1993 |
| JP | 2003-221792 | A * | 8/2003 |

* cited by examiner

*Primary Examiner*—William Phillip Fletcher, III
(74) *Attorney, Agent, or Firm*—Workman Nydegger

(57) ABSTRACT

A method of waterproof and floor construction by using thixotropic urethane and fabric sheet includes the steps of applying a primer on a base concrete surface to form a primer layer; disposing waterproof fiber sheets on the primer layer with an interval in the range of 5 to 10 mm and connecting the intervals with tapes to form a fiber sheet layer; applying thixotropic urethane having viscosity in the range of 900,000 to 1,000,000 CP onto the fiber sheet layer; and spraying super high speed hardening type resin onto the thixotropic urethane to form a coating layer.

3 Claims, 1 Drawing Sheet

METHOD OF WATERPROOF AND FLOOR CONSTRUCTION BY USING THIXOTROPIC URETHANE AND FABRIC SHEET

CROSS-REFERENCE TO RELATED APPLICATIONS

The present invention claims the benefit of priority under 35 U.S. C. §119 to Korean Patent Application No. 2007-11520, filed on Feb. 5, 2007, having a translated title of "METHOD OF WATERPROOF AND FLOOR CONSTRUCTION BY USING THIXOTROPIC URETHANE AND FABRIC SHEET," the content of which is incorporated herein by reference in its entirety.

BACKGROUND OF THE INVENTION

1. The Field of the Invention

The present invention relates to a method of waterproof and floor construction by using thixotropic urethane, in which a thixotropic high viscosity urethane is applied onto fiber sheets formed of fiber materials as a base fixing material before forming an upper coating layer with super high speed hardening type resin, so that generation of pinholes in the upper coating layer can be prevented, a path for humidity induction and a superior reactivity can be provided in case of retraction and expansion of a structure caused by atmospheric temperature difference and vibration, and permeation of humidity into cracks of the structure can be prevented, thereby maximizing stability of waterproof and floor structure.

2. The Relevant Technology

In general, waterproof, corrosion proof, and floor material coating films are on roofs and outer walls of various buildings, tunnels, basements, floors of parking lots, insides of water treating boxes and the like formed according to the purpose thereof. That is, a corrosion proof coating film is formed on a ship or an iron frame, and a coating film of high strength and high durability is formed on the floor of the parking lot or the floor of an industrial facility.

Such the waterproof, corrosion-proof or floor coating film has to be sufficiently adhered to a base layer to secure water tightness, and is imparted with flexibility and behavior reaction property to sufficiently stand impact or vibration transmitted from the outside and volume deformation caused by temperature difference between winter and summer seasons.

As for the waterproof and floor construction, polyurea resin is directly sprayed onto a concrete surface in general. The polyurea resin is superior in the anti-corrosiveness and chemical resistance and forms an elastic and smooth film. If a spraying angle thereof is controlled, embossing may be formed on the surface to promote the slippage-proof and appearance-improving effect. Further, the polyurea resin has an advantage that the reaction speed and curing speed thereof are very fast so that the polyurea resin is widely utilized for the purpose of forming the waterproof and floor construction.

The polyurea resin has, however, a disadvantage that the water tightness of the concrete is not good when the polyurea resin is directly sprayed onto the concrete, so that pinholes are generated and the surface becomes uneven. Therefore, in order to overcome the generation of the pinholes, a non-woven fabric or an asphalt sheet is utilized to wrap the concrete surface before applying the polyurea resin. However, this is also a complicated work and results in the bad walking feeling in the case of roof waterproofing because of the non-woven fabric or the asphalt sheet.

Further, when reinforcing the waterproof layer with the non-woven fabric, the surface of the non-woven fabric may become rough owing to a coating film applied to the non-woven fabric, and moisture of the coating film or paint may be absorbed into the non-woven fabric in a short time, resulting in the deterioration of the construction thereof. In addition, it is very difficult to form a hole in the non-woven fabric to pass coating materials owing to the own properties of the non-woven fabric, so that it becomes difficult to form an insulating or partial insulating waterproof structure. Therefore, reaction property to the behavior of the base element becomes deteriorated so that the reaction to the cracks or humidity of the base element becomes decreased.

Korean Patent Laying-Open Publication No 2006-14901 as filed on Feb. 16, 2006 discloses "a method for waterproof coating by using polyurea resin and a surface controlling material", wherein polyurethane resin having a low hardening time is utilized as the surface controlling material. The method as disclosed in the Korean Patent Laying-Open Publication No 2006-14901 includes the steps of removing impurities from a surface of a base element, applying a primer first onto the surface of the base element, applying the surface controlling material onto the primer by a predetermined thickness, applying the primer secondarily, and applying polyurea resin. The prior art method utilizes the property of the polyurethane, which is slow in hardening and has self-leveling function. The self-leveling function makes a flat surface controlling material layer formed by the fluidity of the polyurethane, wherein the polyurethane has viscosity in a predetermined range to secure the fluidity.

The prior art waterproof coating method has, however, a disadvantage that it is impossible to apply the polyurethane resin used as the surface controlling material to a construction surface when the construction surface is wet (the present inventors' Korean Patent No. 565908 published on Mar. 31, 2006). In the prior art method, all of the primer, the surface controlling material and the polyurea are applied on the entire surface of a waterproof base surface, so that the reaction to the behavior of the base surface becomes decreased, resulting in the loosening of the waterproof base layer or generation of cracks.

Korean Patent No. 565908 discloses a waterproof construction method, which includes the steps of removing impurities from a surface of a base element by using a mixture of an aqueous polymer composition consisting of cement as the surface controlling material, a dispersing agent, inorganic powder composed of mineral based inorganic substances, water soluble emulsion acryl, water and stabilizer, spraying water on the base element from which the impurities are removed to make the base element wet, removing water staying on the surface of the base element before 20-30 minutes from applying the surface controlling material, applying the surface controlling material onto the surface of the base element, applying a primer onto the base element, and applying polyurea resin onto the base element.

This prior art method has an advantage that the waterproof construction may be achieved when the base surface is wet as well as the base surface is dry. However, the prior art method still has disadvantages that working procedure thereof becomes complicated owing to the repetition of the wet and dry states and that the humidity of the base concrete element is not properly discharged, deteriorating the properties of the waterproof layer. Further, the waterproof material including the surface controlling material is applied on the entire surface of the base element so that the waterproof material cannot react to the behavior of the base surface.

Korean Patent No. 408010 discloses a waterproof construction method using polyurea, wherein a non-woven fabric serving as a reinforcement element is fixed to a waterproof base surface by nails or washers before spraying and coating the polyurea. This prior art method has, however, disadvantages that the fixing elements such as the nails or the washers may damage the waterproof structure and are apt to be corroded by the humidity introduced via defect portions, weakening water tightness of the entire waterproof structure.

BRIEF SUMMARY OF THE INVENTION

Therefore, the present invention is derived to resolve the above and any other disadvantages of the prior art, and an object of the invention is to provide a method for waterproof and floor construction, in which waterproof fiber sheets and a thixotropic high viscosity urethane serving as a fixing material for the fiber sheets are provided before forming an upper coating layer with super high speed hardening type resin, so that generation of pinholes in the upper coating layer can be prevented, a path for humidity induction and a superior reactivity can be provided in case of retraction and expansion of a structure caused by atmospheric temperature difference and vibration, and permeation of humidity into cracks of the structure can be prevented, thereby maximizing stability of waterproof and floor structure.

Another object of the present invention is to provide a method for waterproof and floor construction, in which a fiber sheet layer is applied with urethane having high viscosity in the range of 900,000 to 1,000,000 CP to fix the fiber sheet layer effectively in the entire waterproof structure. The urethane is supplied into holes formed in the net structure of the fiber sheet layer so as to form a semi-insulating or partially insulating structure, so that such the semi-insulating or partially insulating structure may improve reaction property with respect to the behavior of the base element and form humidity induction paths to discharge humidity effectively, thereby overcoming the problems such as loosening or cracking of the waterproof or floor layer.

A further object of the present invention is to provide a method for waterproof and floor construction, in which the fiber sheets are provided with a predetermined interval (5-10 mm) in the width direction for simple repair in the case that an upper coating material or any other waterproof structure is damaged or polluted, thereby reducing maintenance cost.

In order to achieve the above objects, according to the present invention, there is provided a method for waterproof and floor construction, including the steps of: applying a primer on a base concrete surface to form a primer layer; disposing waterproof fiber sheets on the primer layer with an interval in the range of 5 to 10 mm and connecting the intervals with tapes to form a fiber sheet layer; applying thixotropic urethane having viscosity in the range of 900,000 to 1,000,000 CP onto the fiber sheet layer; and spraying super high speed hardening type resin onto the thixotropic urethane to form a coating layer.

These and other objects and features of the present invention will become more fully apparent from the following description and appended claims, or may be learned by the practice of the invention as set forth hereinafter.

BRIEF DESCRIPTION OF THE DRAWINGS

The objects, features and advantages of the present invention will be more clearly understood from the following detailed description in conjunction with the accompanying drawing, in which.

DETAILED DESCRIPTION OF THE PREFERRED EMBODIMENTS

Figure 1:
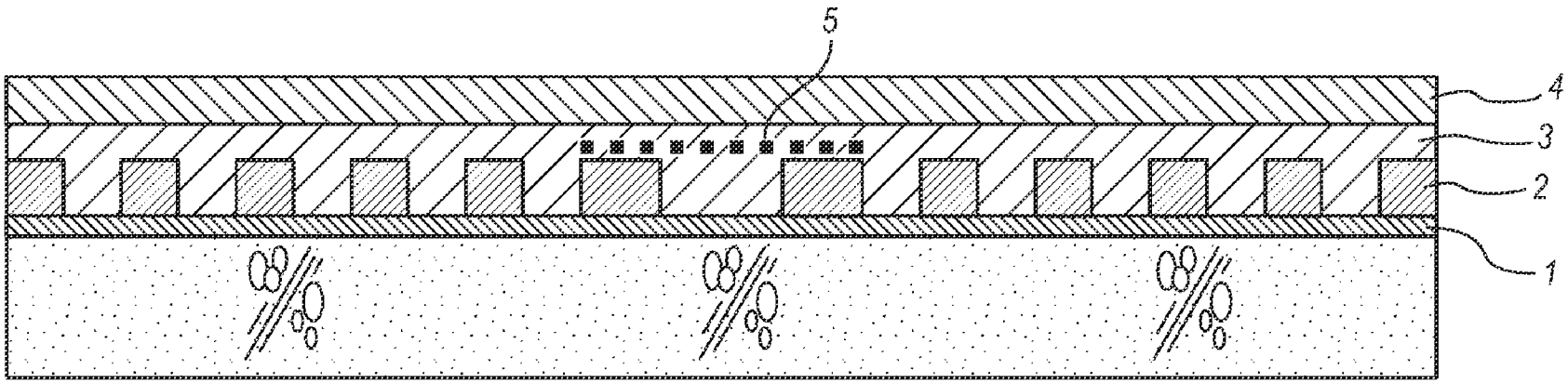
FIG. 1 is a sectional view showing each component part of a waterproof and floor structure constructed according to a construction method of the present invention, wherein the component parts are shown as being expanded partially.

Now, a method for waterproof and floor construction according to the present invention will be described in more detail in the structure and operation thereof with reference to the accompanied drawing.

Referring to FIG. 1, a method for waterproof and floor construction according to the present invention includes the steps of applying a primer on a base concrete surface entirely, disposing waterproof fiber sheets on a primer layer with an interval in the range of 5 to 10 mm and connecting the interval with tapes, i.e., reinforcement tapes to form a fiber sheet layer, applying thixotropic urethane having viscosity in the range of 900,000 to 1,000,000 CP onto the fiber sheet layer to fix the fiber sheet layer, and spraying super high speed hardening type resin onto the thixotropic urethane to form a coating layer.

The fiber sheets are fiber materials formed of knit fabric and have a plurality of holes in the vertical and horizontal direction between dense parts that are woven densely by the fiber materials, wherein connection fibers pass through the holes and the holes preferably have a diameter in the range of 2 to 5 mm. The fiber sheets are not limited thereto but may be any fiber sheets having waterproof function.

The tapes connecting the fiber sheets are preferably fiber tapes of which a surface is applied with an adhesive agent, wherein the tapes are preferably net type fiber tapes which is superior in tensile strength and tear strength since the tape has to connect connection portions between the fiber sheets.

The method for waterproof and floor construction is characterized in that the fiber sheets are applied with thixotropic urethane. The thixotropic urethane serves to fix the waterproof fiber sheets stably in the entire structure and simultaneously serves as a surface controlling material for an upper coating layer, which is formed with super high speed hardening type resin.

The thixotropic urethane is designed as a waterproof paint using elastic urethane resin as a main vehicle and a dried coating layer is imparted with elasticity, so that the coating layer has high durability for retraction and expansion caused by temperature difference or vibration of a building so as to prevent permeation of humidity via cracks. Therefore, the thixotropic urethane exhibits superiority in adhesiveness, elasticity, waterproofness, cold-resistance, and durability.

According to the present invention, the urethane is the thixotropic urethane having viscosity in the range of 900,000 to 1,000,000 CP, which is noticeably higher than the viscosity, that is, 3,000 CP of a usual flow type urethane. When the low viscosity urethane is applied to the fiber sheets, the low viscosity urethane passes through holes of the fiber sheets to the floor and forms a urethane coating layer. To the contrary, the high viscosity urethane has low flow and is filled in the holes of the net structure of the fiber sheets to form partially insulating waterproof structure so as to exhibit superior behavior reaction property.

The thixotropic urethane according to the present invention may be applied on waterproof fiber sheets by using a rubber blade, a rake or any usual tools and applied onto the fiber sheets even when a construction surface is in a slightly wet condition.

The thixotropic urethane is applied as a mixture with a usual hardening agent so as to reduce a hardening time.

A degassing element is mounted on a wall surface and/or a floor surface of a building structure before applying the thixotropic urethane onto the fiber sheets for carrying out the discharge of humidity from the waterproof structure more effectively.

The method for waterproof and floor construction according to the present invention is finished by spraying super high speed hardening type resin onto the thixotropic urethane to form a coating layer.

The super high speed hardening type resin is applied in the shape of a super high speed hardening type coating composition and is preferably polyurea resin or urethane RIM(Reaction Injection Molding). As for the polyurea resin, a two-liquid type one formed of polyisocyanate prepolymer as a first component and a hardening agent of a polyamine mixture as a second component is employed. Or "hybrid polyurea", that is, hybrid polyurea prepared by mixing amine and polyol together and reacting the result with iocyanate prepolymer is preferably employed. The polyurea resin is applied to the thixotropic urethane layer by using a spray gun.

Further, if a spraying angle is controlled when spraying the super high speed hardening type resin by high pressure, embossing effect is achieved for minimizing slippage-resistance and frictional noise.

The method for waterproof and floor construction according to the present invention may be finished by applying a usual top coating agent onto the super high speed hardening type resin layer in the real practice.

Now, the method for waterproof and floor construction according to the present invention will be described with reference to the accompanied drawing.

FIG. 1 is a sectional view showing each component part of a waterproof and floor structure constructed according to a construction method of the present invention, wherein the component parts are shown as being expanded partially. Referring to FIG. 1, a base concrete surface, a primer layer 1 applied onto the entire surface of the base concrete surface, waterproof fiber sheets 2 disposed on the primer layer 1 with an interval in the range of 5 to 10 mm, reinforcement tapes 5 arranged between the waterproof fiber sheets 2, a thixotropic urethane layer 3 applied onto the fiber sheets 2 to be filled in gaps between the fiber sheets 2 and forming a top layer of the fiber sheets 2 with viscosity in the range of 900,000 to 100,000 CP, and a super high speed hardening type resin layer 4 spray-coated on the thixotropic urethane layer 3.

The thixotropic urethane layer 3 has preferably an extension rate of 400% or higher, hardness of 60±5, tensile strength of 2000 n/cm$^2$ or higher, but is not limited thereto.

The super high speed hardening type resin layer 4 has preferably an extension rate of 450% or higher, hardness of 85±5, tensile strength of 200±3 kgf/cm$^2$, but is not limited thereto.

According to the method for waterproof and floor construction of the present invention, the super high speed hardening type spray coating film using the super high speed hardening type resin layer 4 is dried in several seconds so that people may walk thereon in 3-5 minutes from the construction. Further, the super high speed hardening type spray coating film using the super high speed hardening type resin layer 4 is hardly influenced by temperature or humidity and exhibits high hardening performance at a low temperature, so that the workability may be noticeably improved.

According to the method for waterproof and floor construction of the present invention, the waterproof fiber sheets and the thixotropic high viscosity urethane serving as the fixing material for the fiber sheets are provided before forming an upper coating layer with the super high speed hardening type resin so as to prevent pinhole generation of the upper coating layer, obtain the superior reaction property with respect to the retraction and expansion of a structure caused by external vibration, and prevent permeation of humidity into cracks of the structure, thereby maximizing the stability of waterproof materials and floor materials.

Further, the fiber sheet layer is applied with the urethane having high viscosity in the range of 900,000 to 1,000,000 CP to fix the fiber sheet layer effectively in the entire waterproof structure, so that the urethane is supplied into the holes formed in the net structure of the fiber sheet layer and forms a semi-insulating or partial insulating structure. Therefore, such the semi-insulating or partial insulating structure may improve the reaction property with respect to the behavior of the base element and form the humidity induction paths to discharge humidity effectively, thereby overcoming the problems such as loosening or cracking of the waterproof or floor layer.

Furthermore, the fiber sheets are provided with a predetermined interval (5-10 mm) for simple repair when the upper coating material or any other waterproof structure is damaged or polluted, thereby reducing maintenance cost.

According to the present invention, the high viscosity (non-flow type) urethane serves as the surface controlling material for the base surface and simultaneously serves to flatten or waterproof the base surface, so that a waterproof layer applied thereon may be applied flat without generation of pin holes.

Although the foregoing description has been made with reference to the preferred embodiments, it is to be understood that changes and modifications of the present invention may be made by one of ordinary skill in the art without departing from the spirit and scope of the present invention and appended claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of waterproof and floor construction by using thixotropic urethane and fabric sheets, comprising the steps of:

applying a primer on a base concrete surface to form a primer layer;

disposing waterproof fiber sheets on the primer layer with an interval in the range of 5 to 10 mm and connecting the intervals with tapes to form a fiber sheet layer;

applying thixotropic urethane having viscosity in the range of 900,000 to 1,000,000 CP onto the fiber sheet layer; and spraying hardening resin selected from polyurea resin or urethane RIM onto the thixotropic urethane to form a coating layer, wherein each of the waterproof fiber sheets is made of a knit fabric and has a plurality of holes with a diameter of about 5 millimeters formed in vertical and horizontal directions and having connection fibers passing therethrough, wherein the plurality of holes are separated from each other by woven portions of the waterproof fiber sheets, wherein the spaces between fibers of the woven portions are less than about 2 millimeters.

2. The method as claimed in claim 1, wherein the thixotropic urethane is mixed with a hardening agent.

3. The method as claimed in claim 1, wherein a degassing element is mounted on at least one of a wall surface or a bottom surface of a waterproof structure before applying the thixotropic urethane onto the fiber sheet layer.

* * * * *